United States Patent [19]

Simone

[11] Patent Number: 5,007,578

[45] Date of Patent: Apr. 16, 1991

[54] WRAP-AROUND BODY WITH PROMOTIONAL FLAP EXTENSION

[76] Inventor: Ronald A. Simone, #261 - 3424 Vintage Dr., Modesto, Calif. 95356

[21] Appl. No.: 562,845

[22] Filed: Aug. 6, 1990

[51] Int. Cl.[5] ..... B65D 3/28

[52] U.S. Cl. ..... 229/1.5 B; 206/459; 206/831; 229/160.2

[58] Field of Search ..... 229/1.5 B, 118, 160.2; 206/459, 831; 40/324

[56] References Cited

U.S. PATENT DOCUMENTS

| | | | |
|---|---|---|---|
| 2,134,971 | 11/1938 | Guyer | 206/831 |
| 2,930,479 | 3/1960 | Lowe | 206/459 |
| 3,099,381 | 7/1963 | Meyers | 206/831 |
| 3,183,614 | 5/1965 | Loderhose | 206/831 |
| 4,108,350 | 8/1978 | Forbes, Jr. | 206/831 |
| 4,834,240 | 5/1989 | Dagostine | 206/831 |
| 4,887,718 | 12/1989 | Anderson et al. | 229/160.2 |

FOREIGN PATENT DOCUMENTS

| | | | |
|---|---|---|---|
| 2187169 | 9/1987 | United Kingdom | 206/459 |

*Primary Examiner*—Gary E. Elkins

[57] ABSTRACT

A wrap around body either in the form or of an actual cup or a label applied to a container is made from a paper blank which wraps around itself for more than 360° providing a main body portion and an overlap portion. The wrap around body includes first and second spaced apart secured regions where the blank is secured to itself. The first secured region defines a free end on the overlap portion and the second secured region is located inwardly away from the free end of the overlap portion. The first secured region is releaseable under force thereby providing a liftable flap back to the second secured region. This liftable flap is useable for a number of different functions. It may itself be a coupon or a number of coupons and removable from the remainder of the wrap around body or it may be used to hide prize winning information provided either on the undersurface of the flap or on the body normally covered by the flap.

7 Claims, 1 Drawing Sheet

WRAP-AROUND BODY WITH PROMOTIONAL FLAP EXTENSION

FIELD OF THE INVENTION

The present invention relates to a wrap around body in the form of a cup, or a label applied to a container, with an overlap portion which is used to provide coupons or to hide prize winning information on the body.

BACKGROUND OF THE INVENTION

Promotional give aways in the form of coupons provided on purchased products are becoming more and more popular. These promotional give aways can take a number of different forms. For example, many products are provided with coupons towards future purchases. Often times these coupons are however hidden at the time of purchase and are only made available after the consumer has opened the purchased product.

Instant prizes are also a vary common type of promotional idea. Again, the prize winning information is not available until after the purchased product has been opened by the consumer.

Not only are there different types of promotions but in addition the means of providing these promotions may vary. Again, by way of example, there are a number of different types of promotional cups presently on the market. These promotional cups generally have some type of a tear away region which is used to hide information on the cup.

U.S. Pat. No. 4,171,085 issued Oct. 16, 1979, describes a cup blank having a tear away tab at the vertical seam of the cup. This tear away tab can be used to hide certain information either on or beneath the tab.

A similar arrangement is found in U.S. Pat. No. 3,827,620 issued Aug. 6, 1974. Again, in this patent a tear away tab is provided at the vertical seam used in securing the blank to hold the cup together as a unit.

Canadian Patent 1,178,904 issued Dec. 4, 1984 describes a cup having a "proof of purchase punch out tab" in the side wall of the cup. A similar arrangement is described in Canadian Patent 1,201,666 issued Mar. 11, 1986 where once again the tab is punched directly out of the side wall of the cup.

In all of the arrangements described above, the tear away part of the cup is limited in size and therefore not capable of hiding or providing much in the way of information. Furthermore, in much of the prior art, the tear away parts are secured at one end only and therefore, anything printed beneath them is not truly hidden and can be seen by simply lifting the tear away part. In addition, in an arrangement such as that found in Canadian Patent 1,178,904 noted above the removal of part of the cup wall renders the cup unuseable.

In another cup design which has been in the marketplace a separate pouch of pocket is formed on the outside of the cup wall and this pouch or pocket is then ripped open to provide either coupons or game winning information. This particular cup design suffers from the drawback that it is complicated to manufacture because of the separate step required to provide the pouch or pocket and furthermore, the pouch or pocket is generally quite small in size and usually not capable of hiding or providing much in the way of information.

Canadian Patent 692,744 issued Aug. 18, 1964 shows an interesting box design specifically useable as a pill or medical box.

In this particular box design, it is the last panel that is provided with the adhesive used to secure the entire box together. Therefore, in getting to the inside of the information panel, the entire box must be ripped apart once again rendering it unuseable.

SUMMARY OF THE PRESENT INVENTION

According to the present invention, a wrap around body either in the form of a paper cup, or a paper label around a container, is made from a blank which wraps around itself for than 360° providing a main body portion and an overlap portion. The overlap portion is used to provide or hide promotional material on the wrap around body.

The wrap around body includes first and second spaced apart secured regions where the blank is secured to itself. The first secured region defines a free end on the overlap portion and the second secured region is located inwardly away from the free end of the overlap portion. It is the second secured region which is secured to hold the main body portion together. The first secured region is releasable under force and provides a liftable flap back to the second secured region without affecting the main body portion of the wrap around body.

According to an aspect of the present invention, the second secured region has an outside perforated edge for tearing the liftable flap from the body which is particularly useful in the event that the flap is in the form of a coupon or the like.

BRIEF DESCRIPTION OF THE DRAWINGS

The above as well as other advantages and features of the present invention will be described according to the preferred embodiments of the present invention in which.

DETAILED DESCRIPTION ACCORDING TO THE PREFERRED EMBODIMENTS OF THE PRESENT INVENTION

Figure 1:
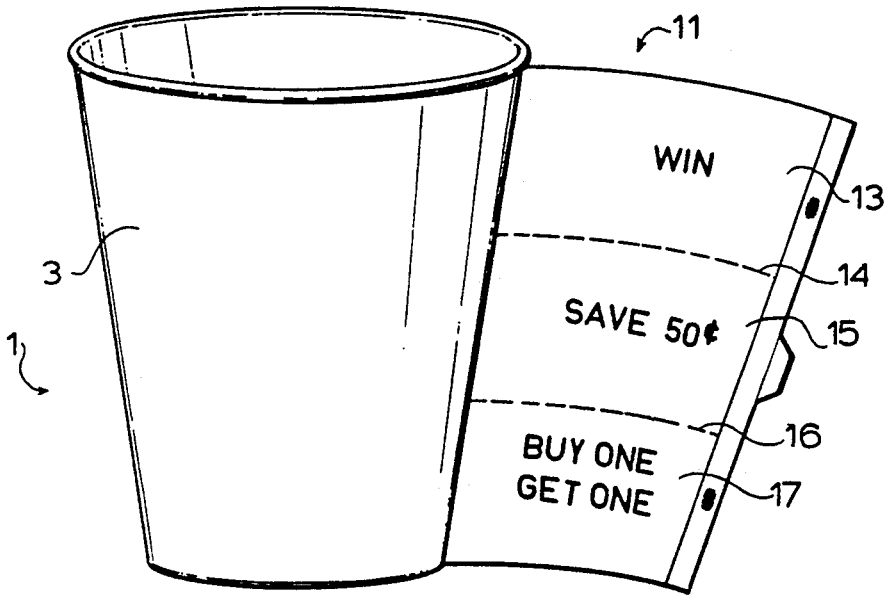
FIG. 1 is a perspective view of a cup made according to a preferred embodiment of the present invention.

FIG. 1 shows a wrap around body in the form of a cup generally indicated at 1. This cup is formed from a blank best seen in FIG. 2 and having a main blank portion 3 which forms the main body portion of the cup shown in FIG. 1, i.e. blank portion 3 rolls upon itself to form the full 360° of the cup.

Figure 2:
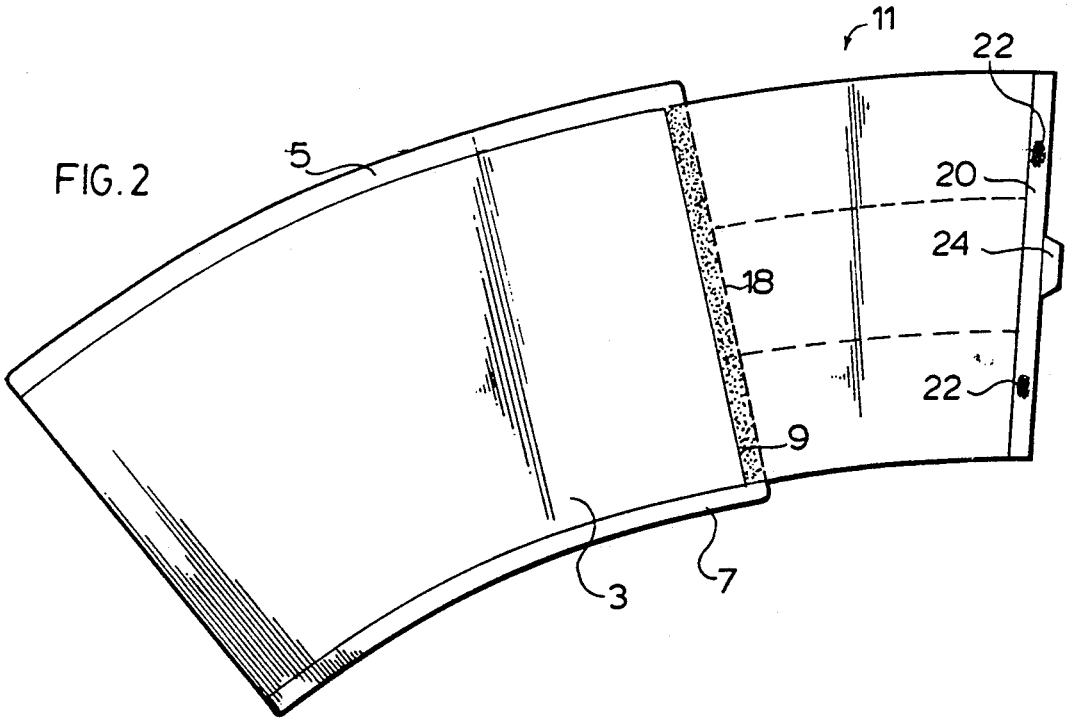
FIG. 2 is a plan view of the blank used to form the cup of FIG. 1.

In addition, the cup blank shown in FIG. 2 includes an overlap portion 11. This overlap portion is not used in forming the main cup body but rather overlaps the 360° formation of the cup body. Therefore, the blank shown in FIG. 2 of the drawings wraps around itself for more than 360° with the overlap portion 11 preferably extending a full 180° around the outside of the already formed cup body.

In forming the cup, the blank body 3 is, as seen in FIG. 2, taller or of increased height relative to the overlap portion 11. The added height is provided by upper and lower blank edges 5 and 7 respectively which when the cup is formed are folded inwardly to provide upper and lower rolled rims on the cup. Once the rims have been formed, the main cup body is of consistent height with the overlap portion 11. Note that the overlap portion is not rolled into the upper and lower rims on the cup.

The blank is provided with a vertically extending adhesive strip 9 which covers the entire height of the blank. In forming the cup, this adhesive strip is secured back onto the main body portion 3 of the blank to hold th 360° formation of the cup body.

The overlap portion 11 is provided with a free end region 20 which includes spot adhesive at the end areas indicated at 22. After the main cup has been formed and secured by the adhesive strip 9, the overlap portion is then continued around overlapping and tightly secured to the outside of the cup by the spot adhesives 22. Note that there are varying adhesive levels, i.e. strength of bond, at strip 9 and spot adhesives 22 with the strip being much more positively secured than the spot adhesives.

As will be appreciated from the description above, the overlap portion 11 can be pulled away from the remainder of the cup body by simply pulling on it and breaking the spot adhesives thereby providing a liftable flap all the way back to the much more permanently secured adhesive region 9. To assist in the lifting of the overlap portion, a pull tab or grip 24 is provided at the free end 20 of the overlap portion 11. Note that the main body of the cup is not affected by the lifting of the flap.

It should be noted that although only a minimal amount of force is also required to lift the overlap or flap portion away from the rest of the cup, the spot adhesives must be strong enough to hold the overlap portion tightly against the outside of the cup prior to lifting the flap. Furthermore, the spot adhesives should not be provided by adhesive material which could be reuseable for resecuring the overlap portion against the cup. This is important because it is not desireable for a potential purchaser to first examine what is hidden by the overlap or flap portion and then decide not to make the purchase which would be understandable.

As described above, in a preferred embodiment of the present invention, the overlap portion extends about 180° around the outside of the cup. This then places the first secured region at the free end 20 of the overlap portion diametrically opposite the second secured region in the form of adhesive strip 9 and provides a balanced positioning of the two secured regions on the cup. This is beneficial in preserving package design used for trademark registration.

Although specific reference is made above to a 180° overlap, it is to be appreciated that something more or less than the 180° overlap could be provided. In any event, the overlap should be such that it is substantial enough to provide a rather significant liftable flap back to the adhesive strip 9. This in turn allows a significant amount of information to be hidden either on the underside of the flap or on the outer face of the cup hidden beneath the flap.

As earlier described, the overlap or flap portion 11 can be used to provide discount coupons. Accordingly, the outside edge of the adhesive strip 9 is perforated as indicated at 18 to allow an easy tearing of the overlap portion 11 from the remainder of the cup. In addition, as indicated in FIG. 1, the overlap portion itself can be divided into different segments indicated at 13, 15 and 17 using horizontally extending perforations 14 and 16 to provide a plurality of separable coupons from the single overlap portion.

According to a further preferred embodiment of the present invention, the outside of the flap is provided with the identical pattern or label material as that which it covers on the main body portion of the cup. Accordingly, the appearance of the cup does not change even though the flap is removed as it would be in the case where the flap is provided with a different pattern or label material.

As will be appreciated from all of the description above, the removal of the overlap portion from the cup does not affect whatsoever the remainder of the cup body. The manufacturing of the cup including both the main blank portion 3 and the overlap portion 11, is not much more expensive than forming a standard cup since the overlap portion is nothing more than an extension of the main blank body. It does not necessitate the inclusion of additional outside pockets, separate game pieces, etc. on the cup.

Again, although the specific description above relates to a wrap around body in the form of a cup. The same concept of providing an overlapping flap with two securing regions is equally applicable to wrap around labels etc. provided to the outside of a can or the like.

Although various preferred embodiments of the invention have been described in detail, it will be appreciated by those skilled in the art that variations may be made without departing from the spirit of the invention or the scope of the appended claims.

I claim:

1. A rolled wrap around body free of corners and formed from a blank which wraps around for more than 360° providing a main body portion and an overlap portion, and first and second spaced apart secured regions on said wrap around body wheresaid blank is secured upon itself, said first secured region defining a free end on said overlap portion, said second secured region located inwardly-away from said free end of said overlap portion, said main body portion presenting a constant wrap around surface on which to secure said first and second spaced apart region, said first secured region being releasable under force and providing a liftable flap back to said second secured region.

2. A wrap around body as claimed in claim 1, wherein said second secured region has an outside perforated edge for tearing said flap from said body without affecting said main body portion.

3. A wrap around body as claimed in claim 2, wherein said flap includes perforations to provide separable flap portions from said flap.

4. A wrap around body as claimed in claim 1, wherein said overlap portion overlaps said main body portion by about 180° with said first and second secured regions being located substantially diametrically opposite one another.

5. A wrap around body as claimed in claim 1, wherein said first and second secured regions are secured by adhesive having varying adhering levels, the adhering level at said first secured region being less than that at said second secured region.

6. A wrap around body as claimed in claim 5, wherein said second secured region comprises an adhesive strip extending the full height of said body, said first secured region being provided by spaced apart spot adhesives at different heights on said body, the adhering level of said spot adhesives being sufficient, when undisturbed, to hold said overlap portion tightly against said main body portion while allowing release of said overlap portion without tearing said body.

7. A wrap around body as claimed in claim 1, comprising a paper cup, said blank being of an increased height at said main body portion relative to said overlap portion and having upper and lower main body portion edges which are folded to provide upper and lower rolled rims on said cup, said main body portion with said rims folded being of a consistent height with said overlap portion for uniform height of said overall cup.

* * * * *